US007054233B2

(12) United States Patent
Kibiloski et al.

(10) Patent No.: US 7,054,233 B2
(45) Date of Patent: May 30, 2006

(54) WALL CLOCK WITH DIAL ILLUMINATION

(75) Inventors: Keith E. Kibiloski, Virginia Beach, VA (US); Charles Wong Tak Chung, Quarry Bay (HK)

(73) Assignee: Equity Industries, Inc., Virginia Beach, VA (US)

( * ) Notice: Subject to any disclaimer, the term of this patent is extended or adjusted under 35 U.S.C. 154(b) by 279 days.

(21) Appl. No.: 10/459,793

(22) Filed: Jun. 12, 2003

(65) Prior Publication Data

US 2003/0231553 A1 Dec. 18, 2003

Related U.S. Application Data

(63) Continuation-in-part of application No. 10/304,329, filed on Nov. 26, 2002.

(60) Provisional application No. 60/387,977, filed on Jun. 12, 2002, provisional application No. 60/334,428, filed on Nov. 30, 2001.

(51) Int. Cl.
*G04B 19/30* (2006.01)
*G04B 37/00* (2006.01)

(52) U.S. Cl. ..... 368/67; 368/227; 368/276

(58) Field of Classification Search ..... 368/227, 368/67, 66, 204, 88, 276
See application file for complete search history.

(56) References Cited

U.S. PATENT DOCUMENTS 4,044,546 A 8/1977 Koike
4,171,769 A 10/1979 Trimpey
4,451,157 A 5/1984 Reap
4,647,217 A 3/1987 Havel
4,702,615 A 10/1987 Havel
4,705,406 A 11/1987 Havel
4,785,432 A 11/1988 Havel
5,088,056 A * 2/1992 McIntosh et al. ..... 702/177
D326,726 S 6/1992 Swain, Jr.
5,128,782 A * 7/1992 Wood ..... 349/61
5,143,433 A * 9/1992 Farrell ..... 362/29
5,309,145 A 5/1994 Branch et al.
5,359,577 A * 10/1994 Hoshino et al. ..... 368/67
5,365,495 A * 11/1994 Cussen ..... 368/79
5,381,388 A 1/1995 Beiswenger et al.
5,465,198 A 11/1995 Kellogg
5,487,053 A 1/1996 Beiswenger et al.
5,524,101 A * 6/1996 Thorgersen et al. ..... 368/10
5,552,779 A * 9/1996 Gaskill et al. ..... 340/7.56

(Continued)

*Primary Examiner*—Vit W. Miska
(74) *Attorney, Agent, or Firm*—Cook, Alex, McFarron, Manzo, Cummings & Mehler, Ltd.

(57) ABSTRACT

A wall clock of the analog type with hands for indicating the time includes a battery, a housing, a dial with time indicia disposed in the housing and an illumination module disposed adjacently to the dial. The illumination module has one or more recesses defined in an edge with one or more light sources disposed in the recesses to provide illumination into the module. The illumination module has edges and a back surface with light reflective properties to reflect light in the interior of the module and out the front surface and through the dial to provide night lighting exterior to the clock. Preferably, the module has an ovate shape such that the recesses and light sources are disposed outside of the dial area. A light sensor senses the ambient lighting conditions and activates and deactivates the light source. The starting and ending times for illumination may also be programmed into the clock. A battery icon has a plurality of bars to indicate the remaining battery capacity. A dimmer control adjusts the desired level of illumination.

15 Claims, 6 Drawing Sheets

U.S. PATENT DOCUMENTS 5,610,741 A 3/1997 Kimura
5,712,795 A * 1/1998 Layman et al. ..... 700/297
5,714,247 A 2/1998 Kuo et al.
5,926,440 A 7/1999 Chien
5,936,688 A 8/1999 Tsuda et al.
D423,698 S 4/2000 Yuen
6,158,868 A 12/2000 Chien
6,166,793 A 12/2000 Hayashi et al.
6,236,443 B1 * 5/2001 Carlsen ..... 349/143
6,280,053 B1 8/2001 Chien
6,292,439 B1 9/2001 Akiba et al.
6,334,689 B1 * 1/2002 Taniguchi et al. ..... 362/31
6,459,890 B1 * 10/2002 Kim ..... 455/351
2001/0033481 A1 10/2001 Chien

* cited by examiner

WALL CLOCK WITH DIAL ILLUMINATION

CROSS-REFERENCE TO RELATED APPLICATION

This patent application is a non-provisional application of prior U.S. provisional patent application Ser. No. 60/387,977, filed on Jun. 12, 2002, and is a continuation-in-part application of U.S. patent applications "Clocks Having Diffusion Reflector Lighting", Ser. No. 10/304,329, filed on Nov. 26, 2002 and Ser. No. 60/334,428, filed on Nov. 30, 2001, the rights of priority of which are hereby claimed for this patent application.

BACKGROUND OF THE INVENTION

This invention generally relates to clocks having multiple features including unique lighting and time display features. More particularly, a preferred embodiment of the invention relates to illumination of the dial of the clock, which may be associated with a night light feature that may activate and deactivate automatically in response to ambient lighting conditions, or that may activate and deactivate in response to user programmed times.

Typically, wall clocks are mounted on a wall at a higher elevation, usually at eye level or higher. This positioning is usually not near an available electrical outlet, which are frequently located relatively close to the floor. As a result, wall clocks that derive their operating power from conventional AC power systems need an AC power outlet installed near where the clock is to be mounted on the wall. This alternative is often inconvenient, or it is too costly to install a new outlet for the wall clock.

Another alternative is to have an electrical cord dangling from the wall clock to the lower electrical outlet. However, many persons believe that such exposed power cords are unsightly and interfere with the décor of the home or the office.

There is therefore a need for an illuminated wall clock with a self-contained power source that avoids the problems associated with an AC-powered wall clock.

A need also exists for a wall clock with an illumination system that places a small current demand or load on the self-contained power source. Replacement or replenishment of the power source should ideally be as infrequent as possible.

Also desirable is an illumination system for a wall clock that efficiently converts light from a light source into illumination for the dial of the wall clock for easy viewing of the displayed time, and that also provides dispersed lighting into a room to serve as a night light.

It is therefore a general object of the present invention to provide an improved wall clock having a self-contained power source with various illumination features.

It is another object of the present invention to provide an improved wall clock with a light module to efficiently provide illumination of the face of the clock and to provide sufficient light dispersion out of the light module for night lighting of the room in which the clock is located.

A further object of the present invention is to automatically activate the illumination features when the ambient lighting falls below a predetermined threshold, and to automatically deactivate the illumination when the ambient lighting rises above a predetermined threshold.

Yet another object of the present invention is to provide the capability for the user to program the wall clock for his/her desired illumination activation characteristics.

Another object of the present invention is to provide an improved wall clock with an LED light source that is positioned in an edge of the illumination module.

SUMMARY OF THE INVENTION

The present invention is directed to various illumination features for a wall clock of the analog type with hands for indicating the time. The wall clock has a self-contained power source, such as one or more batteries. The illumination may be automatically activated in response to low ambient lighting conditions, such as encountered during the evening hours, and that is automatically deactivated when normal ambient lighting conditions return in the morning hours. A light sensor is used to detect the ambient lighting levels. The time and duration of the illumination may be programmed by the user. A dimmer control adjusts the amount of illumination provided by the illumination module.

A light illumination module, including a light emitting diode (LED), in combination with light reflector, is disposed either in front of, or behind, the clock dial to provide uniform lighting of the dial of the clock and to provide sufficient light dispersion out of the light module for night lighting of the room in which the wall clock is located. The light illumination module is preferably of ovate shape, with an enlarged end that has one or more recesses defined therein to receive one or more light sources, such as LEDs. This enlarged end of the illumination module, with the recesses and light sources, typically extends beyond the normal viewing area of the dial of the clock, and is hidden from view by the frame or housing of the clock.

For best light transmission and dispersion from the light sources to illuminate the dial of the clock and to provide night lighting in the room, the illumination module is preferably transparent, such as of clear acrylic plastic, with the edges of the module having reflective properties, such as provided by reflective coatings or paint. However, the edges of the recesses, in which the light sources are disposed, are clear for receiving illumination from the light sources into the illumination module.

The illumination module is typically positioned behind the dial. The dial is clear or translucent except for the time or other indicia on the dial and the back surface of the illumination module may be coated with a generally opaque reflective coating, or have a reflective material disposed behind the illumination module, such as plastic sheet material, foils, or the like. Such sheet material or foils may be embossed, engraved, imprinted by silk screen techniques, or the like, to enhance light dispersion in and out of the illumination module. If the illumination module is disposed in front of the dial, the back surface of the illumination module will be clear to see the indicia on the dial, and the dial will be generally opaque and reflective to reflect and disperse illumination about the dial and out of the illumination module to provide night lighting.

In accordance with other aspects of the present invention, a programmable timer may be programmed by the user to selectively control the starting time and the ending time of the illumination of the dial of the clock. A battery level indicator may have multiple levels to alert the user to the level of charge remaining in one or more batteries, such as full, medium, medium low, low and no battery capacity. For example, the battery level indicator may be in the form of a display having four bars for full, three bars for medium, two bars for medium low, one bar for low and no bars for no capacity.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures in which like reference numerals identify like elements, and in which:

DETAILED DESCRIPTION OF THE INVENTION

Figure 1:
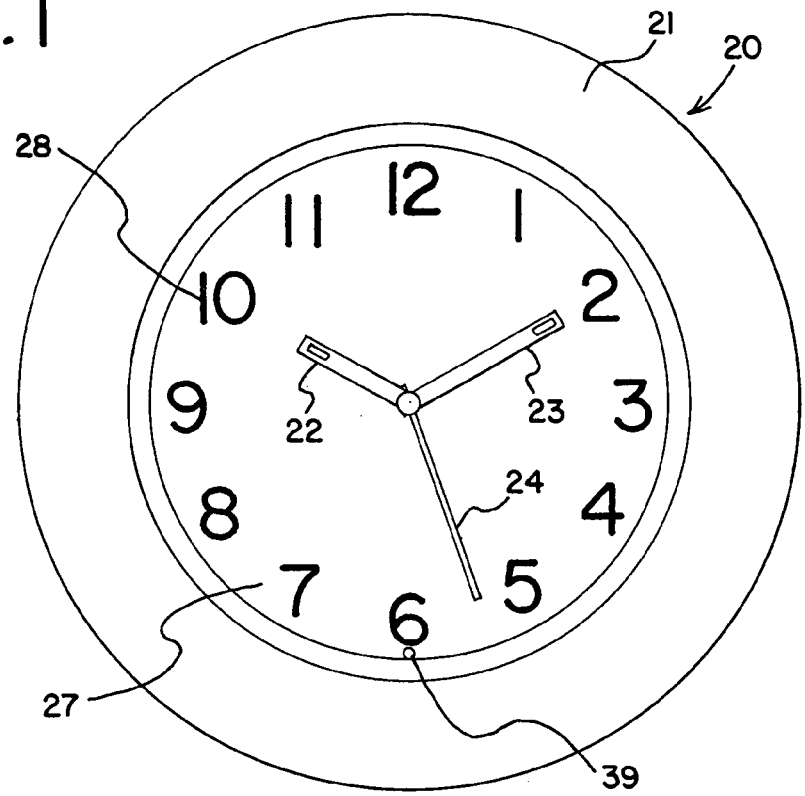
FIG. 1 is a front elevational view of a wall clock with ambient light sensing for automatic activation and deactivation of the lighting functions in accordance with the invention.

Referring to the Figures, and particularly to FIG. 1, a clock, generally designated 20, is constructed in accordance with the invention. Clock 20 is of the analog type with hands, such as an hour hand 22, a minute hand 23 and a second hand 24, for indicating the time.

Figure 2:
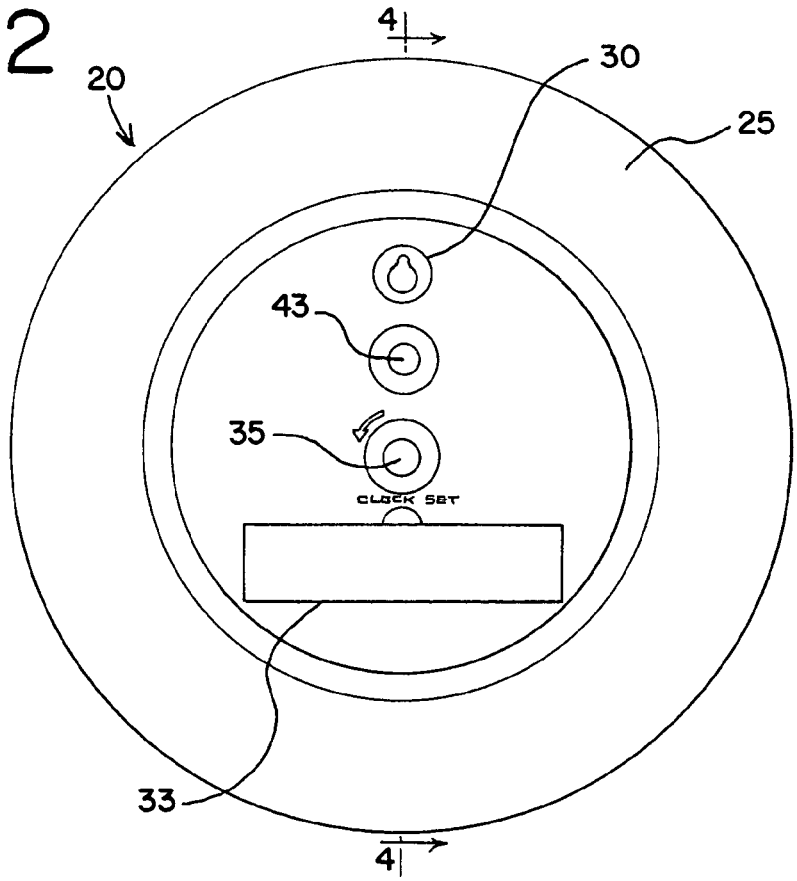
FIG. 2 is a rear elevational view of the wall clock illustrated in FIG. 1.

Clock 20 has a housing including a generally annular front frame 21 and a rear housing portion 25 (FIG. 2). In addition to the shape depicted in the drawing figures, frame 21 can be supplied with other ornamental features or be configured into other ornamental shapes, as desired. Frame 21 can also be fabricated from different materials. For example, to satisfy the tastes of consumers, frame 21 could be different colors of plastic, different types of wood or different metals. As one example, in FIGS. 1–4, clock 20 may have a frame 21 formed from a thermoplastic, as by injection molding. Frame 21 and rear housing portion 25 may snap fit together by means of techniques well-known in the plastic molding arts.

A generally transparent lens 26 may engage the frame 21 to enclose and to protect the time indicating hands 22–24 from damage, and to keep dust and contaminants from accumulating in the interior of clock 20. Lens 26 may be formed, for example, from a transparent plastic material. Lens 26 may be in the form of the continuous curvature shown in FIGS. 3 and 4, or any other suitable shape, including ornamental shapes.

Clock 20 has a dial or face 27 which is provided with a plurality of time-indicating numerals, such as the numeral "10" at 28, disposed thereon. The "NIGHT VISION" mark and logo shown on the dial 27 are trademarks of Equity Industries Corp.

Figure 3:
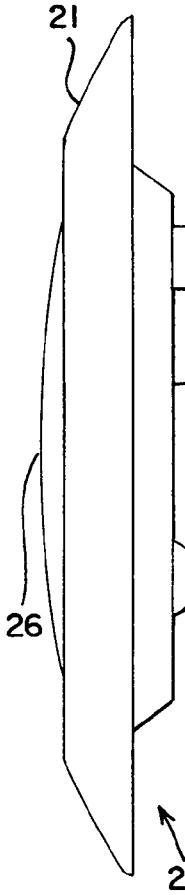
FIG. 3 is a side elevational view of the wall clock illustrated in FIGS. 1 and 2.
Figure 4:
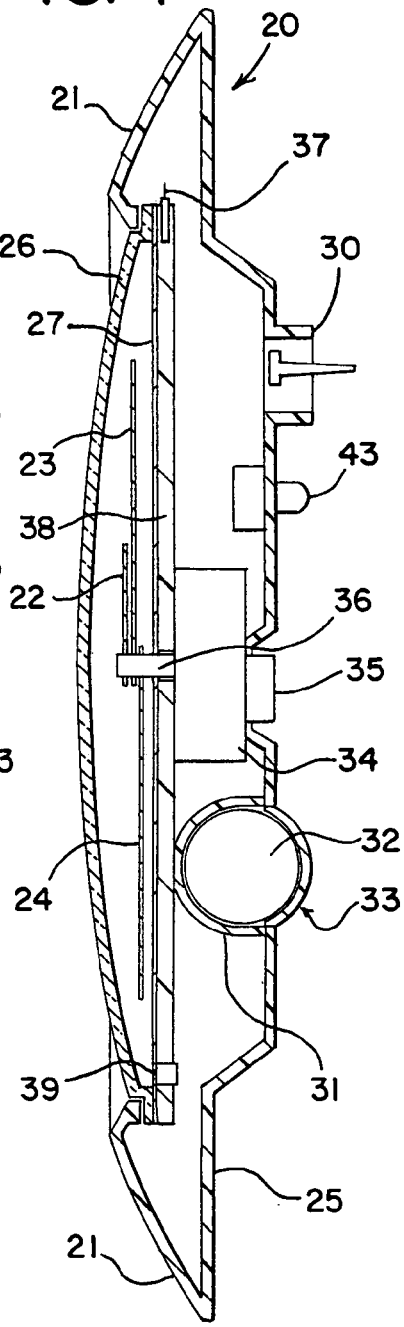
FIG. 4 is a cross-sectional view of the wall clock illustrated in FIGS. 1–3 taken along the sectional line 4–4 of FIG. 2.

With reference to FIGS. 3 and 4, rear housing portion 25 has a raised boss 30 suitable for hanging clock 20 on a wall, as with a fastener, such as a nail or screw.

Disposed partially inside rear housing portion 25 is a battery compartment 31 for housing one or more batteries 32. Batteries 32 are a self-contained power source for clock 20, including for the various illumination features described below. For example, batteries 32 may be batteries of the alkaline type, such as the commonly available C size.

There are, of course, other alternatives to alkaline batteries. Rechargeable batteries could be used in place of the alkaline batteries. The front of clock 20 could also incorporate one or more solar cells to provide operating current for the clock during the daylight hours, with the batteries 23 acting as back-up power during the evening hours. Such solar cells could also use any excess power capacity to recharge the rechargeable batteries during the day.

An elongated battery compartment cover 33 retains the batteries 32 within the compartment 31. Cover 33 protrudes from the rear of housing portion 25 by about the same distance as mounting boss 30. Thus, when clock 20 is mounted on a wall, boss 30 and battery cover 33 cooperate to orient clock 20 in a vertical plane that is generally parallel to the wall.

As seen in FIG. 4, clock 20 has a movement 34 adapted to move the time indicating hands 22–24. Movement 34 is preferably of the quartz type for excellent time accuracy. Shafts of the movement 34 extend through apertures, such as an aperture 36 in a reflector 38. A knob 35 can be rotated, as indicated in FIG. 2, to initially set the time for clock 20.

Figure 5:
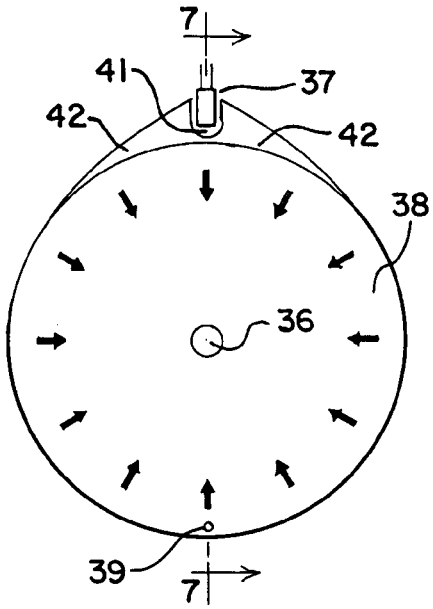
FIG. 5 is a front elevational view of an illumination module with a single light source for use in the wall clock illustrated in FIGS. 1–4.
Figure 7:
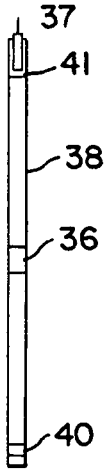
FIG. 7 is a cross-sectional view of the illumination module of FIGS. 5 and 6 taken along the sectional line 7—7 of FIG. 5.

In accordance with one aspect of the present invention, an illumination module illustrated in FIG. 5, consisting of a light emitting diode (LED) 37 in combination with a light reflector 38, provides lighting for the dial 27 of the clock 20 under dim lighting conditions typically found in homes or offices after sunset. LED 37 and reflector 38 also provide sufficient light radiation to function as a night light in unlit or dimly lit rooms. Disposed near the bottom edge of reflector 38 is a light sensor 39, such as a photoelectric cell. Light sensor 39 continually senses the light level of the room in which clock 20 is located. When the ambient light level falls below a predetermined threshold, light sensor 39 causes LED 37 to be electrically energized by batteries 32 to activate illumination from LED 37 for clock 20. Similarly, if the ambient light level rises above a predetermined threshold, light sensor 39 causes LED 37 to be electrically disconnected from batteries 32 to deactivate any illumination. The light sensor 39 can be disposed in the aperture 40 defined near the bottom edge of reflector 38 (FIG. 7). A dimmer knob 43 can be rotated to set the dial illumination to any desired level between low and high positions.

Dial 27 is in front of, and generally overlies the reflector 38. For good light transmission therethrough, dial 27 is generally transparent, except for the generally opaque time-indicating numerals 28 and other indicia, such as the trademark Night Vision.

Figure 6:
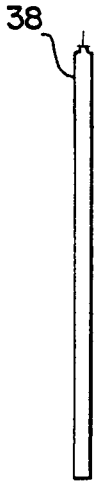
FIG. 6 is a side elevational view of the illumination module illustrated in FIG. 5 and for use in the wall clock illustrated in FIGS. 1–4.

The light illumination module including LED 37 and reflector 38 is better seen in FIGS. 5–7. With reference to FIG. 5 first, when the dial 27 is of generally circular configuration, as in the embodiment illustrated in FIGS. 1–4, the reflector 38 is preferably of generally ovate shape. That is, a portion of reflector 38 extends above the circular dial 27 for enclosing LED 37 in a recess 41 formed in the reflector 38. Thus, recess 41 and LED 37 are not visible when viewing the face of the clock. In this example, recess 41 is of generally U-shape in the top edge of reflector 38, and LED 37 is disposed therein.

The optical properties of reflector 38 contribute significantly to the efficiency of the light module to illuminate the dial 27 and to provide sufficient illumination from clock 29 for night light capability. Reflector 38 is ideally transparent and may be formed from a clear acrylic plastic material. As seen in FIG. 6, the edge periphery of the reflector 38 is coated with an optically reflective and opaque coating such that light from LED 37 is reflected back into the interior of the reflector from all angles. This optically reflective coating may be, for example, a white paint.

The front side of reflector 38 that abuts the dial 27 in FIG. 4 is uncoated and transparent for light transmission therethrough. The U-shaped recess 41 is also uncoated to facilitate maximum light transmission from the LED 37 into the reflector 38. However, portions of the front side of reflector 38 that are not visible from the front of the clock, such as those portions designated 42 on either side of LED 37 are also optically coated for maximum light reflectivity from LED 37 into the central area of reflector 38.

The back side of reflector 38 is also preferably coated to provide a light reflective surface. Light dispersion from the reflector 38 through the dial 27 and into the room in which the clock 20 is located is also desired to provide a night light function.

LED 37 is preferably disposed within a recess or notch, such as in the U-shaped recess 41 defined in the periphery of reflector 38 such that virtually all of the light emitted by LED 37 is gathered and transmitted by the reflector 38.

Figure 8:
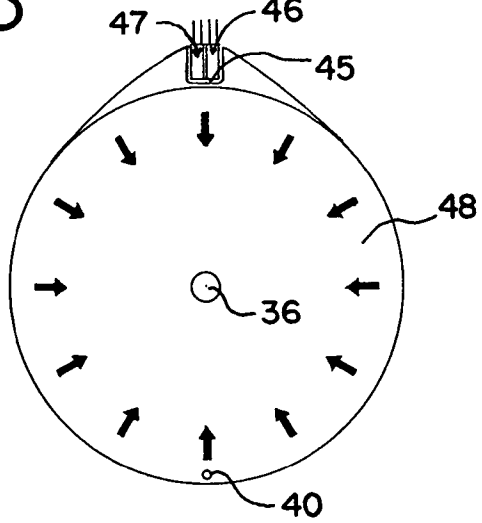
FIG.8 is a front elevational view of an illumination module with two light sources for use in the wall clock illustrated in FIGS. 1–4.

Clock 20 may, of course, be provided with more than one LED. Shown in FIG. 8 is a reflector 48 with a larger U-shaped recess 45 suitable accommodating two LEDs 46 and 47. LEDs 46 and 47 preferably provide different color light for enhanced lighting effects in clock 20. LEDs 46 and 47 may also indicate different clock conditions. For example, LED 46 may be of a yellow color to indicate normal functioning of clock 20, and LED 47 may be of a red color to indicate low battery capacity, to indicate that batteries 32 need replacement.

Of course, it will be apparent that many alternatives exist to the described structure for clock 20. For example, instead of a separate dial 27 with the time indicia 28 disposed in front of the reflector 38, these two elements could be combined by printing the time indicia 28 on the back side of reflector 38 prior to coating the back side of reflector 38 with the reflective coating. Yet another example is that separate recesses could be provided for each LED 46 and 47 in the reflector design of FIG. 8 instead of the single enlarged recess 45 for containing both LEDs 46 and 47.

Figure 9:
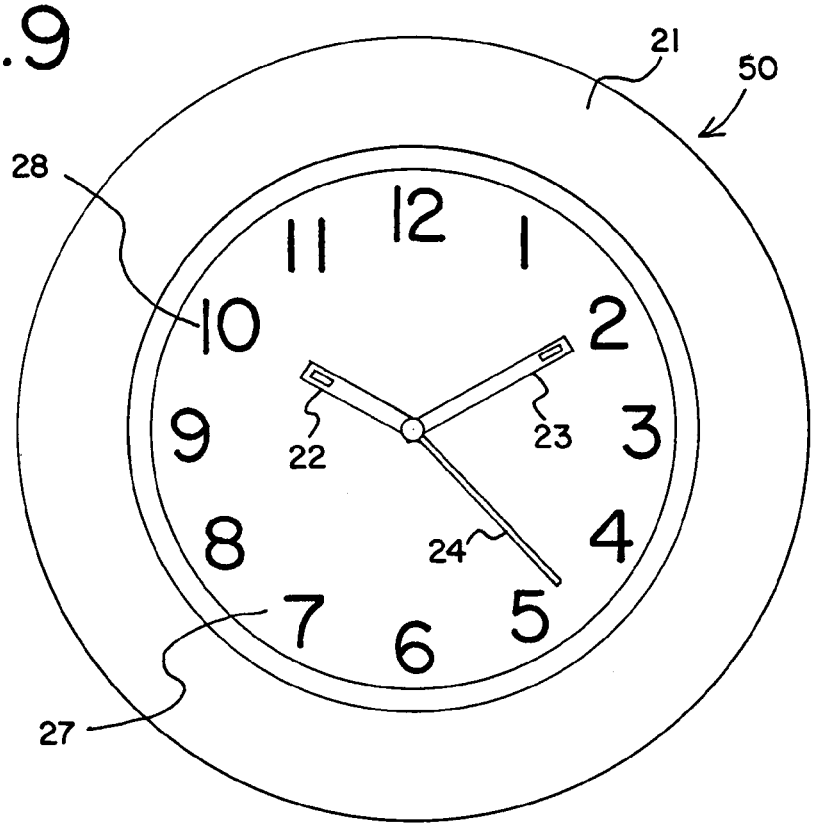
FIG. 9 is a front elevational view of a wall clock with user programmable activation and deactivation of the illumination functions in accordance with the invention.
Figure 10:
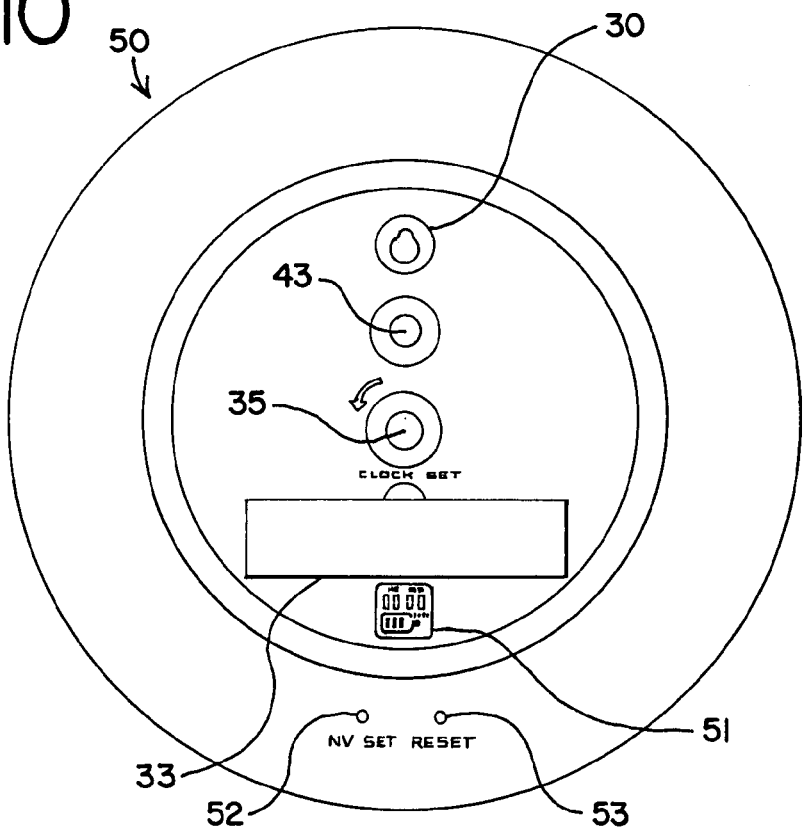
FIG. 10 is a rear elevational view of the wall clock illustrated in FIG. 9.

Shown in FIGS. 9 and 10 is a second embodiment of a clock, generally designated 50, constructed in accordance with the invention. In many respects, clock 50 is similar in structure to clock 20. However, it will be noticed that clock 50 does not have a light sensor 39 disposed near the bottom of the dial 27. Clock 50 is intended to be programmable by the user to set the times at which the clock 50 activates dial illumination and the time at which dial illumination is deactivated. To this end, a digital timer module 51, a set button 52 and a reset button 53 are disposed on the rear of clock 50, as can be seen in FIG. 10.

Figure 12:
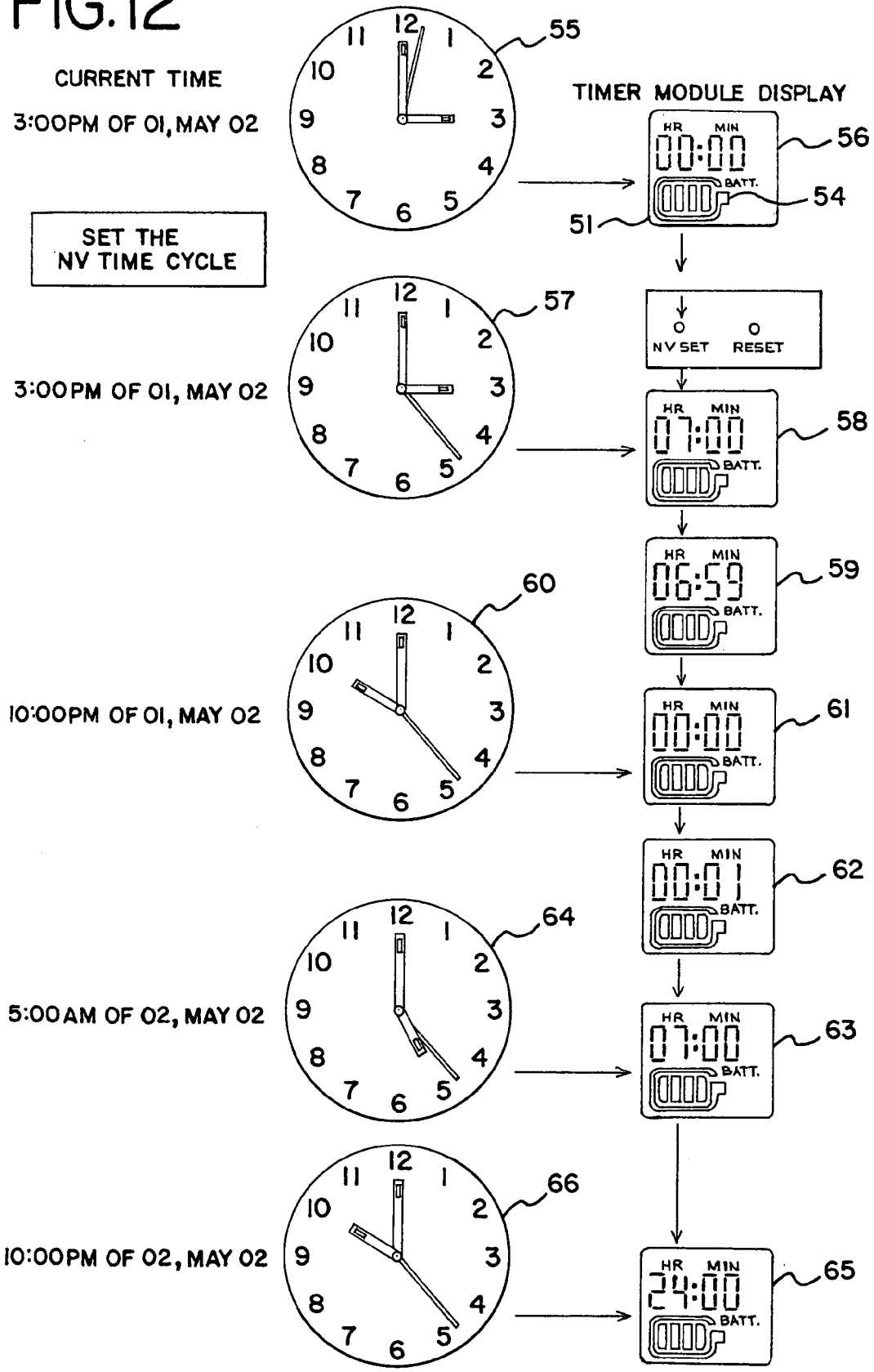
FIG. 12 is a pictorial diagram of the steps for programming the activation and deactivation of the illumination functions for the wall clock illustrated in FIGS. 9 and 10.

The steps of programming clock 50 are shown in FIG. 12. As will be appreciated hereinafter, the timer module 51 operates independently of the analog clock movement 34, i.e., clock 50 and timer module 51 are not normally synchronized. However, if the time of activation is selected as midnight, it will be appreciated that timer module 51 will display "01:00" at 1 AM as it counts up from "00:00" at midnight. In this instance, timer module 51 will display "13:00" at 1 PM. Also, the timer module 51 has different modes in which it may be counting up or counting down. Timer module 51 may be a display of the liquid crystal display (LCD) type.

In the example illustrated in FIG. 12, it is assumed that the current time is 3:00 PM, as shown in the top depiction 55. At this same time, timer module 51 indicates "00:00", as at depiction 56. If it is desired to start the night illumination in seven hours at 10:00 PM, set button 52 is pressed seven times. Each pressing of set button 52 increments the time displayed by timer module 51 by one hour. Thus, after seven pressings, timer module 51 indicates the time as "07:00", as shown in the depiction 58. If set button 52 is not again pressed within a predetermined time, such as about 10 seconds, timer module 52 begins counting down to zero time as shown in depiction 59 in FIG. 12. When timer module 51 reaches the zero count, as shown in depiction 61, the time will be 10 PM as shown in corresponding depiction 60. Upon reaching zero time, timer module causes one or more LEDs to illuminate the face 27 of the clock 50.

Upon reaching a zero count and activating the illumination feature for the clock 50, timer module 51 begins to count up, as shown in depiction 62. Upon the timer module reaching a preset count, such as seven hours in this example and as shown in depiction 63, timer module 51 causes the illumination of the face of clock 50 to be deactivated. In this example, the illumination started at 10 PM, so seven hours later when the illumination is deactivated, the time is 5 AM as shown in depiction 64. Thereafter, timer module 51 continues to count up until it reaches "24:00", as shown in depiction 65. At this 24:00 count, it will again be 10 PM as shown in depiction 66. Thus, the illumination is again activated, and the count of the timer module 51 is reset to zero. Timer module 51 will continue to cycle thereby activating and deactivating the illumination for the face of the clock every day at the previously programmed times.

In the foregoing example, the set button 52 was pressed seven times because of the seven hour difference between the present time of 3 PM and the desired 10 PM illumination activation time. If the illumination is to be activated at 11 PM, and the present time is also 3 PM, set button 52 will need to be pressed eight times to start the down counter from "08:00". The foregoing example also assumes a fixed seven hour illumination period. Under this assumption, if illumination is activated at 11 PM, then deactivation of the illumination occurs at 6 AM.

The above examples assume the clock 50 is programmed on the hour. However, if the present time is 3:30 PM and "07:00" is entered into timer module by set button 52, illumination will be activated seven hours later at 10:30 PM and the illumination will be deactivated at 5:30 AM.

Rather than this fixed seven hour illumination period, provision could easily be made for programming in the duration of the illumination. That is, the duration of the illumination could be varied in accordance with the user's desires. For example, as the length of the evening varies with seasonal changes, the user may also wish to vary the duration of the illumination provided by the clock 50. Furthermore, rather than activating and deactivating the illumination on an hourly basis, another set button (comparable to set button 52) could be provided for entering minutes into the timer module 51, if so desired.

At any time, the user may press the reset button 53 to terminate the previously programmed illumination schedule. The user may then begin programming a different illumination schedule by pressing the set button, as described above.

Figure 11:
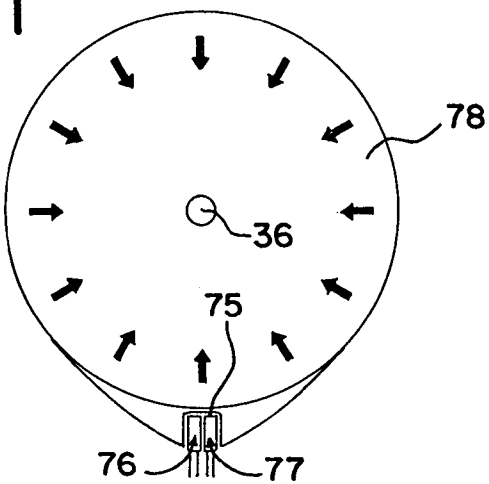
FIG. 11 is a front elevational view of an illumination module for use in the wall clock illustrated in FIGS. 9 and 10.

Illustrated in FIG. 11 is a reflector 78 for the clock 50 which utilizes two LEDs 76 and 77 disposed in a U-shaped recess 75. Reflector 78 may be similar to the two-LED reflector 48 for clock 20 that is shown in FIG. 8. Note, however, that reflector 78 does not have an aperture 40 for a light sensor 39. Thus, LEDs 76 and 77 may be disposed along a bottom edge of reflector 78 since there is no aperture 40 or light sensor 39 adjacently disposed to the LEDs 76 and 77 that could interfere with some paths of light transmission from the LEDs 76 and 77.

Other variations may be made to the design of the various reflectors 38, 48 and 78 of FIGS. 5, 8 and 11, respectively. For example, instead of the previously described reflective coating on the back sides of these reflectors, a reflective surface could be disposed along the back side of these reflectors 38, 48 or 78, such as metal foil, colored plastic sheet materials, or the like.

Figure 14:
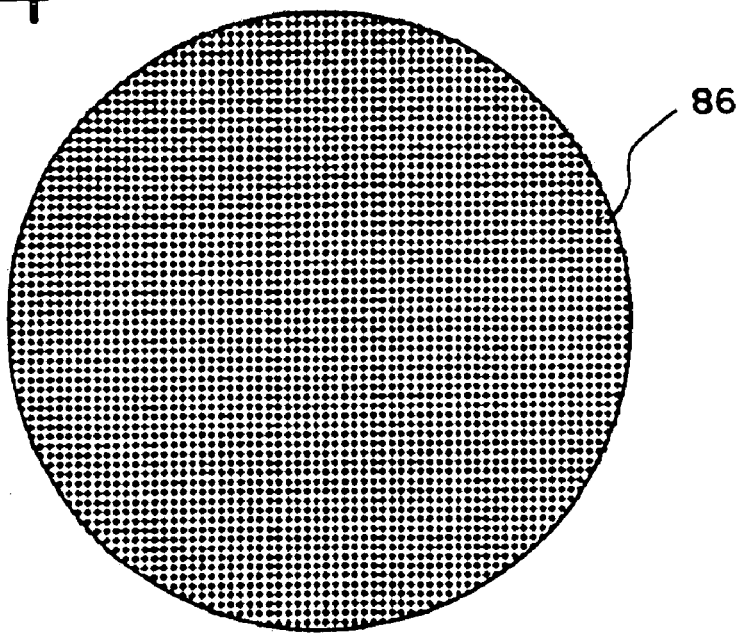
FIG. 14 is a dot matrix pattern that may be employed in the reflector of the clocks illustrated in FIGS. 1–4 and 9–10.
Figure 15:
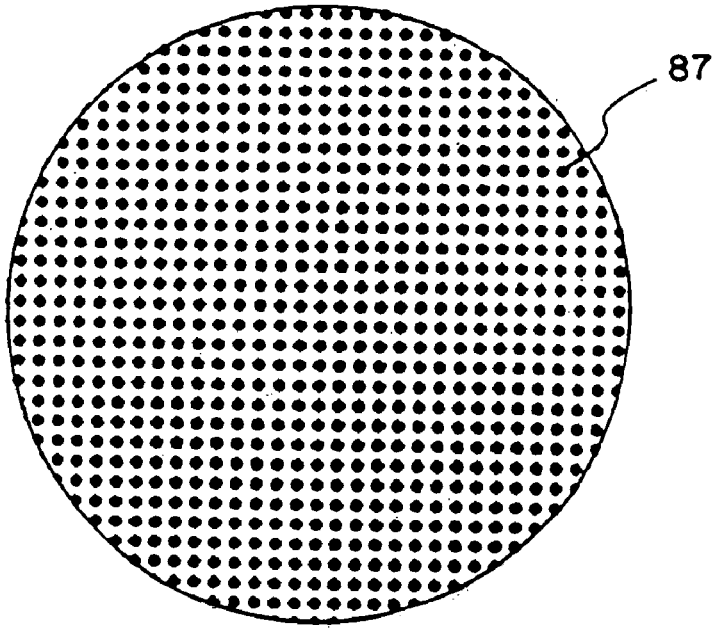
FIG. 15 is an alternative dot matrix pattern that may be used in the reflector of the clocks illustrated in FIGS. 1–4 and 9–10.

The back side of reflectors 38, 48 or 78 could alternatively be engraved to provide multiple raised surfaces, such as points, bumps, protuberances, or the like. FIGS. 14 and 15 illustrate surfaces 86 and 87, respectively, created by dot engraving techniques. Such rough surfaces result in increased dispersion of light from the dial 27 of the clocks 20 and 50 to provide more efficient night light capability. Use of engraving techniques can also provide more interesting backgrounds as seen through the dial 27 of the clocks 20 and 50, including textures, decorative designs, decorative patterns, or the like. If a plastic sheet material or a metal foil is used on the back side of reflectors 38, 48 or 78, as described above, such sheet materials or foils may also be embossed with textures, designs or patterns. Silk screen techniques may also be employed to imprint patterns, textures or designs on the back sides of reflectors 38, 48 or 78, or upon any sheet materials or foils disposed on or against the back sides of the reflectors.

Illumination modules, such as reflectors 38, 48 and 78, also have utility in providing lighting in other applications. For example, these illumination modules may also be used to provide illumination of street numbers for homes, businesses and apartments. Similarly, these illumination modules can provide illumination for mailboxes, light posts and the like. They can also provide background illumination for advertisements, signs, information panels and the like. For example, signs that are typically illuminated include emergency, exit and entrance signs in public buildings.

Figure 13:
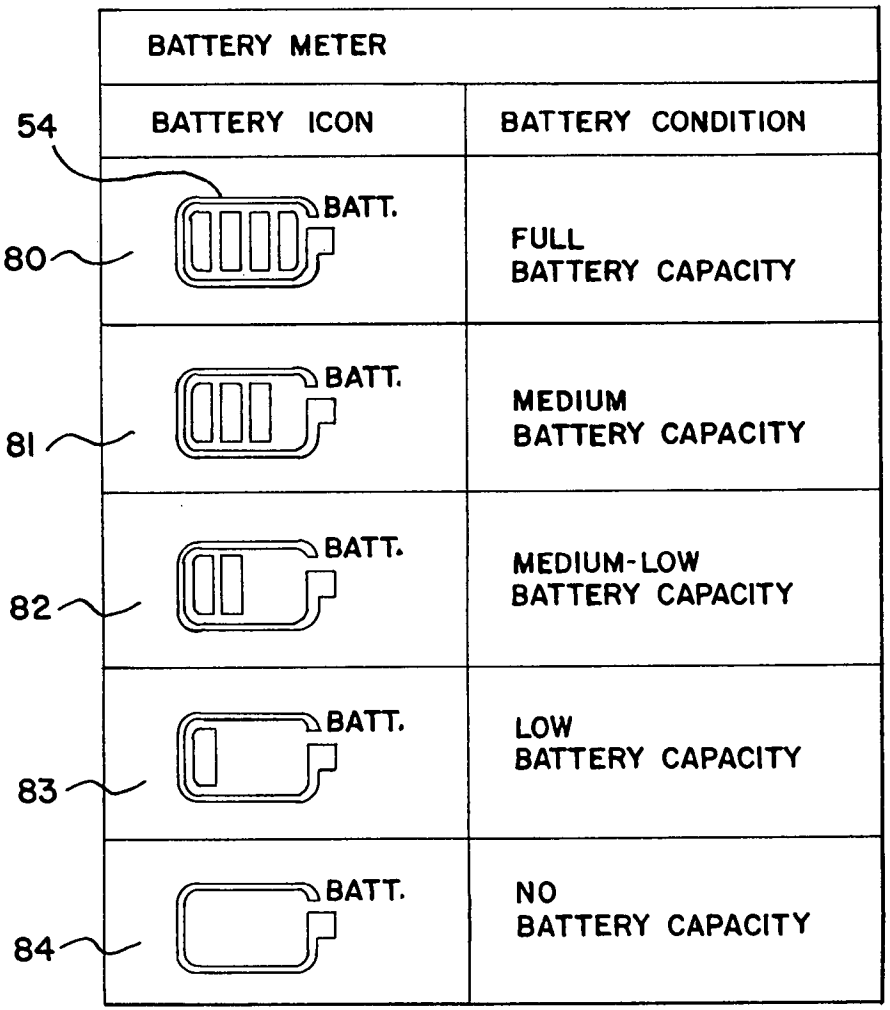
FIG. 13 is a pictorial diagram of a battery level indicator for indicating the remaining capacity of the battery for the wall clock illustrated in FIGS. 9 and 10.

As previously seen in FIG. 12, the timer module 51 may include a battery indicator 54 to provide useful information about the remaining battery capacity. For example, as shown in FIG. 13, battery indicator 54 may have four separately operable segments. As shown in depiction 80, when battery indicator 54 has all four segments activated or illuminated, the batteries 32 have full capacity. As further shown in depiction 81, activation of three segments may indicate medium remaining battery capacity. Depiction 82 illustrates two segments, which may indicate medium-low remaining capacity. Depiction 83 illustrates one segment, which may indicate low remaining capacity. The absence of any activated segments, as in depiction 84, may indicate that no batteries 32 are installed in battery compartment 31, or that the batteries 32 are too low in capacity to be useful.

Of course, the timer module 51 could be located on the front of the clock 50, as on the frame 21 or on the back side of the reflector 78, rather than on the back side of clock 50 as shown in FIG. 10. Also, the timer 56 and battery indicator 54 of the timer module 51 could be physically separate displays disposed at different locations on clock 50, rather than combined together as shown in FIGS. 10 and 12.

It will be understood that the embodiments of the present invention that have been described are illustrative of some of the applications of the principles of the present invention. Various changes and modifications may be made by those skilled in the art without departing from the true spirit and scope of the invention.

What the claimed is:

1. A wall clock of the analog type with hands to indicate the hour and minute; said wall clock comprising:

a housing;

a battery to supply power to the wall clock;

a dial disposed in the housing, said dial containing indicia for the hours, said dial being generally transparent;

an illumination module with generally planar front and rear surfaces, said illumination module of generally ovate shape with an enlarged end, said illumination module disposed in the housing with the front surface of said illumination module disposed behind and adjacently to the dial, said illumination module having a recess defined in the edge of the illumination module at the enlarged end; and a light source comprising one or more light emitting diodes disposed in said recess to provide illumination into said illumination module;

said edge of the illumination module having light reflective properties, except in the recess, to reflect light about the interior of said illumination module and out the front surface of the illumination module and through said dial to provide illumination exterior to said clock.

2. The wall clock in accordance with claim 1 wherein said rear surface of the illumination module has light reflecting properties.

3. The wall clock in accordance with claim 1 wherein said rear surface of the illumination module has an engraved surface to improve light dispersion within and out of the front surface of said illumination module.

4. The wall clock in accordance with claim 1 wherein a light reflective material is disposed adjacently to the rear surface of the illumination module to reflect light within and out of the front surface of said illumination module.

5. The wall clock in accordance with claim 1 wherein said illumination module is formed of a clear plastic material.

6. The wall clock in accordance with claim 1 further comprising a light sensor to sense the ambient lighting conditions, to activate the light source when the ambient lighting conditions are below a predetermined threshold, and to deactivate the light source when the ambient lighting conditions are above the predetermined threshold.

7. The wall clock in accordance with claim 1 further comprising:

a programmable time control to program the time that the light source will be activated and to program the time that the light source will be deactivated.

8. The wall clock in accordance with claim 1 further comprising a dimmer control to control the amount of illumination provided by the light source to the illumination module.

9. The wall clock in accordance with claim 1 wherein said rear surface of the illumination module has an engraved surface to improve light dispersion within and out of said illumination module.

10. The wall clock in accordance with claim 1 further comprising:

a second recess defined in the edge of said illumination module; and a second light source disposed in the second recess.

11. The wall clock in accordance with claim 10 wherein said second light source is of a different color than said light source.

12. The wall clock in accordance with claim 11 wherein said second light source is a red color and is activated when the battery needs replacement.

13. The wall clock in accordance with claim 1 further comprising:

a battery icon to indicate the level of charge remaining in the battery.

14. The wall clock in accordance with claim 13 wherein said battery icon has a plurality of bars to indicate the level of charge remaining in the battery.

15. The wall clock in accordance with claim 14 wherein said battery icon has a plurality of bars to indicate the level of charge remaining in the battery, with all of said plurality of bars activated when the battery has full charge and none of said plurality of bars activated when the battery has insufficient charge remaining.

* * * * *